United States Patent [19]

Staats

[11] 3,992,741

[45] Nov. 23, 1976

[54] FOLD BIND MACHINE

[75] Inventor: Henry N. Staats, Deerfield, Ill.

[73] Assignee: General Binding Corporation, Northbrook, Ill.

[22] Filed: May 12, 1975

[21] Appl. No.: 576,386

[52] U.S. Cl. ..... 11/1 R
[51] Int. Cl.[2] ..... B42C 19/00
[58] Field of Search ..... 11/1 R, 1 AD, 3, 4; 281/29, 21

[56] References Cited

UNITED STATES PATENTS

| | | | |
|---|---|---|---|
| 3,321,786 | 5/1967 | Bolick | 11/1 AD |
| 3,717,366 | 2/1973 | Decker | 11/1 R X |
| 3,730,806 | 5/1973 | Heller et al. | 281/21 RX |

FOREIGN PATENTS OR APPLICATIONS

| | | | |
|---|---|---|---|
| 1,222,016 | 8/1966 | Germany | 11/1 R |

*Primary Examiner*—Lawrence Charles
*Attorney, Agent, or Firm*—Hill, Gross, Simpson, Van Santen, Steadman, Chiara & Simpson

[57] ABSTRACT

A machine for making a thin booklet by binding loose sheets into an adhesive cover, the machine including a vertically disposed groove-shaped heater unit adapted to receive the folded edge of the adhesive cover and further including a roll pinching station disposed closely adjacent the heater unit and adapted to receive therebetween the adhesive cover and sheet assembly, the roll pinching station including a pair of rolls which are biased against each other and serve to squeeze the edge of the adhesive cover assembly to effect an equal distribution of the adhesive along the edges of the sheets being bound in the adhesive cover.

14 Claims, 7 Drawing Figures

Fig. 3
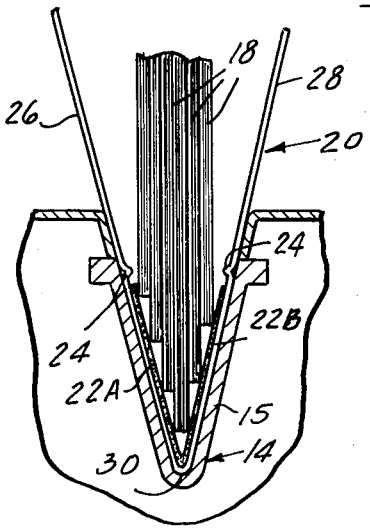
Fig. 6
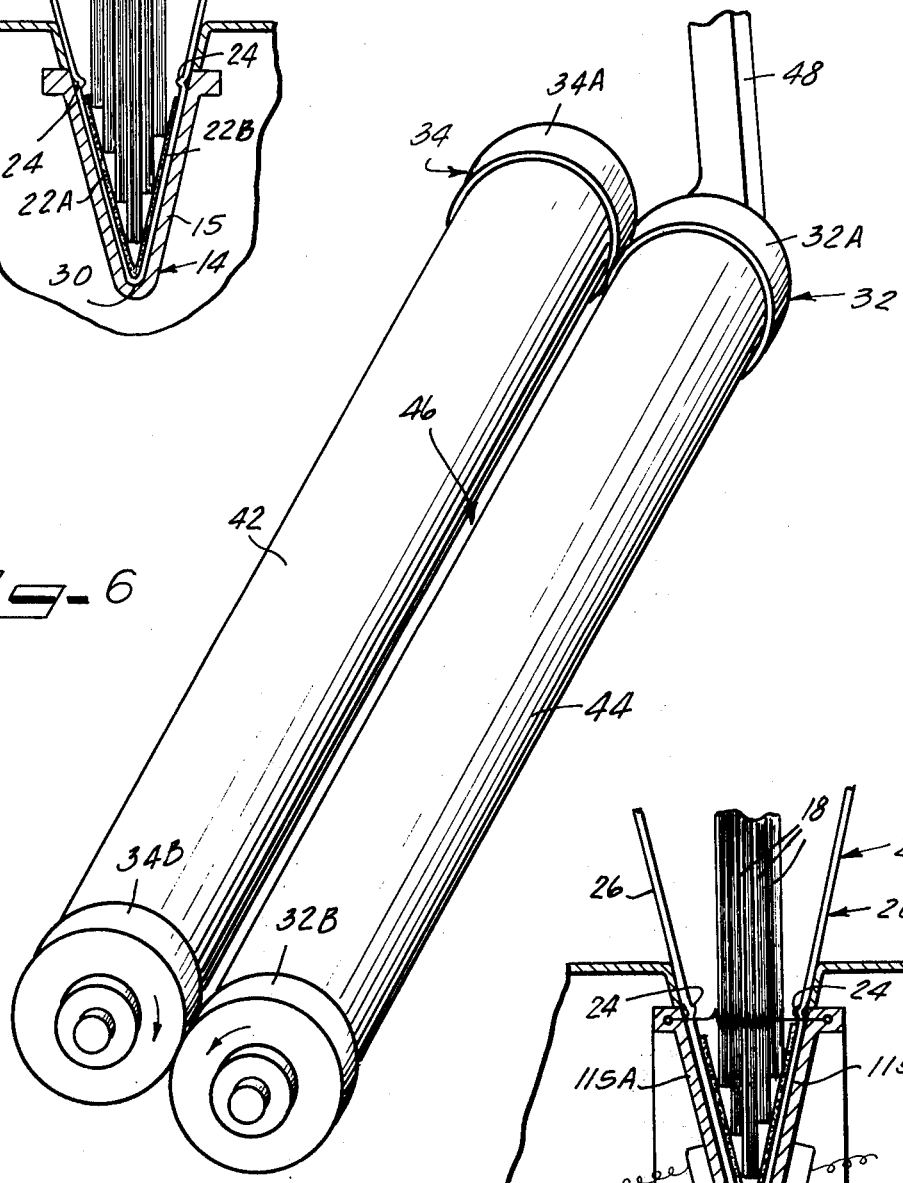
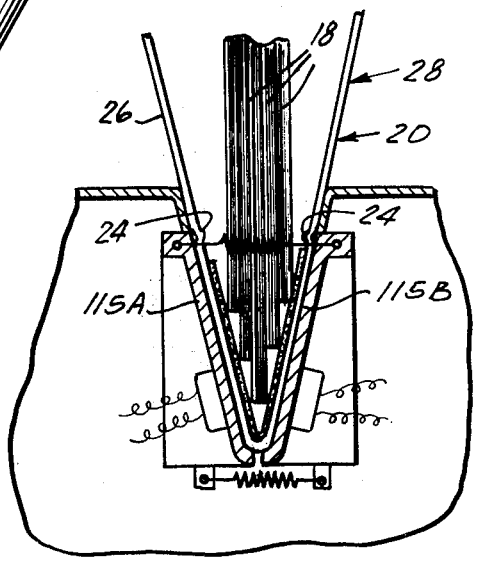
Fig. 7

FOLD BIND MACHINE

BACKGROUND OF THE INVENTION

This invention relates to apparatus for binding one or more loose sheets into thin booklets using an adhesive cover.

The general subject matter of this case, insofar at least as it deals with binding covers for books and the like, having a heat reactivatable adhesive secured to the backbone or spine thereof, is related to co-pending U.S. application Ser. No. 516,690, assigned to the same assignee as this application.

SUMMARY OF THE INVENTION

A principal object of the present invention is to provide a simple, low cost machine to bind loose sheets into a thin booklet using an adhesive cover.

Another object of the present invention is to provide in a machine for binding thin booklets, a combination of a heater unit and a roll pinching station.

Another object of the invention is to provide in a machine for binding thin booklets a shaped heater unit to accommodate the shape of the booklet to be bound.

Another object of the invention is to provide in the machine a roll pinching station for squeezing together the folded cover edge to achieve better distribution of the adhesive.

Still another object of the invention is to provide in the machine signal means for indicating the dwell time of a booklet being bound in the heater unit.

By way of summary, the invention herein provides a small economical, easy to construct machine for binding fold-binder covers. It includes a small shaped heater unit into which the folded edge of the assembled cover and the paper sheets may be inserted and held there for an easily timed period and a roll pinching station into which the heated cover and paper assembly is inserted to appropriately distribute the adhesive over the sheet edges to maximize the binding effect.

Other objects and advantages of the invention will become more apparent when considering the following description in conjunction with the accompanying drawings.

BRIEF DESCRIPTION OF THE DRAWINGS

FIG. 3 is an end view of an adhesive fold-binder cover disposed in the heater portion of the machine of FIG. 1 and containing a plurality of sheets to be bound therein;

FIG. 6 is a perspective view showing the two rolls of the roll pinching station with a gap therebetween;

FIG. 7 is a modified view of a heater unit having two separate elements.

DESCRIPTION OF A PREFERRED EMBODIMENT

Figure 1:
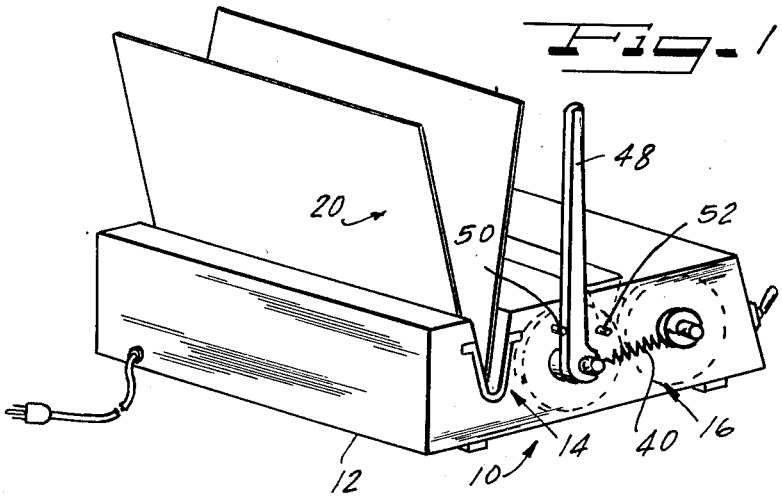
FIG. 1 is a perspective view of a thin cover binding machine embodying the invention herein.

Referring now to the drawings wherein like reference characters in the several views refer to similar parts, there is shown in FIG. 1 a fold-bind machine 10 embodying the invention herein. The machine 10 includes a housing 12, a heater assembly 14 disposed in said housing, and a roll pinching station 16 disposed in said housing alongside the heater assembly 14. The machine 10 is used for binding one or more loose sheets 18 into an adhesive cover 20.

The housing 12 may comprise a substantially rectangular box-like unit with the heater assembly 14 being disposed at one side thereof and the roll pinching station being disposed alongside the heater assembly within the housing.

The adhesive cover 20 includes an adhesive layer 22 of heat reactivatable adhesive which generally ranges in size from one-half inch to one inch in width and approximately 0.006 inches to 0.012 inches in thickness. This adhesive layer is disposed at the center or midpoint of the cover 20 between scores 24. Covers are scored so that when a bound booklet is opened at the cover — the cover preferentially bends at the score — instead of stressing the adhesive joint which may encourage the first bound sheet or the inside of the cover to split (or separate from the adhesive). Both covers are scored so user does not have to worry about orienting a cover when he assembles the book. Before binding, i.e., a scored cover always will appear as a front cover. As seen in FIG. 3, for example, the adhesive cover 20 comprises front and back cover members 26 and 28. The adhesive layer 22 has been applied to the cover 20 which is then folded along line 30 resulting in the layer of heat reactivatable adhesive 22 lying in the crotch of the cover and disposed up the sides of the front and back covers approximately equidistantly on each side as portions 22A and 22B.

The heater assembly 14 comprises an elongated substantially V-shaped extrusion member 15 which is as long as or slightly longer than the fold-binder cover which it is adapted to receive. The extrusion preferably is made of metal such as aluminum, for example, a metal being chosen of good heat conducting properties.

One or more heater elements 17 are connected to the extrusion member 15 to heat the latter. A thermostat 19 associated with the heater assembly and connected to pilot light 21 is effective to indicate when the heater has been brought up to a proper temperature to begin the cover binding operation.

The heater elements, of course, are connected by appropriate means to a power source through electrical conduit means.

The heater assembly 14 provides sufficient heat to reactivate the hot melt adhesive within the cover. After heating the cover and sheet assembly a reasonably accurate period of time, it is removed and the folded edge is inserted into the nip of two resilient rolls biased against each other whereupon a lever connected to one of the roll shafts may be actuated a limited distance so that the assembly is drawn into the roll nip just enough to simultaneously spread the adhesive slightly within the folder and chill the edge of the assembly to produce an early bond which permits use and handling shortly after removal from the machine.

The heater 14 is vertically oriented in the machine 10 and is preferably deliberately shaped to receive a folded and shaped cover which may contain one to thirty typical sheets of office paper, that is of a twenty pound base, for example. The heater capacity preferably is limited to cover stock measuring, roughly 0.006 inches to 0.008 inches in thickness and thirty or so sheets each measuring about 0.004 inches in thickness. Thicker cover stock reduces the number of sheets permitted while thinner cover stock would permit the use of more sheets. In other words, any combination of cover and/or paper thickness may be employed to obtain more or less sheets but in a preferred embodiment of the machine, the heater has been designed to accommodate a maximum number of thirty sheets since the predominant need for binding in industry and commerce results in reports, booklets and presentations in the one to thirty page category. This is not to say, however, that the design of the apparatus disclosed herein must necessarily be limited to the one to thirty page category because success has been achieved in using heating arrangements and appropriately configured covers in binding applications extending well beyond sixty pages.

The general concept of a vertically oriented heater was employed because it has been noted that when assembling cover and paper followed by a sharp rap in vertical position the manual transfer of the cover in the same plane to a heater in the same plane tends to preserve the positioning of paper within the cover so that maximum exposure of paper to adhesive is achieved. While the vertically oriented heater is preferable, that does not mean that a horizontally disposed heater could not also be used.

The concept of shaping a grooved heater to roughly match the shape of a fold-binder containing sheets is important because it tends to place the outer surfaces of the cover in more or less intimate contact with the heater surfaces. This permits the introduction of heat efficiently in the least amount of time and at temperature levels which will not scorch or discolor typical cover stock.

It will be appreciated that a cover containing several sheets develops one shape and a cover containing thirty or more sheets develops a somewhat different shape. However, a shape has been arrived at which is an acceptable compromise with heating efficiency maximized with the worst situation at thirty sheets. Fewer sheets extract less heat so that while the thinner assembly fits the heater less efficiently, the overall time to bind without exterior scorch is not much different from one book thickness to another in the one to thirty sheet range.

The idea of using a shaped heater does not, of course, limit the method since other means of heating and shapes of heaters also work, although sometimes less efficiently.

Typical hot melt adhesive in combination with cover stock in the 0.006 inches to 0.008 inches thickness range and thirty sheets of typical twenty pound office paper of approximately 0.0035 inches to 0.004 inches in thickness can be processed reliably, a shaped heater of the type disclosed herein operating at temperatures between 325° F. and 355° F. in twelve seconds. Fewer sheets and/or thinner paper and thinner cover stock requires less time. Accordingly, this means that the most difficult configuration processes in an optimally designed machine at a rate of 250 to 300 bound objects per hour, which is well within or exceeds the rate possible with other common binding approaches.

Efficiency may be improved either by employing shaped or unshaped heaters and applying two heating members 115A and 115B lightly spring biased against one another as shown in FIG. 7 so that an assembly thrust between the elements will separate the heaters, thus placing them in intimate contact with the covers. The advantage of a grooved one piece heater over a two piece heater is that the former is less expensive than the latter; however, either approach will work.

Figure 4:
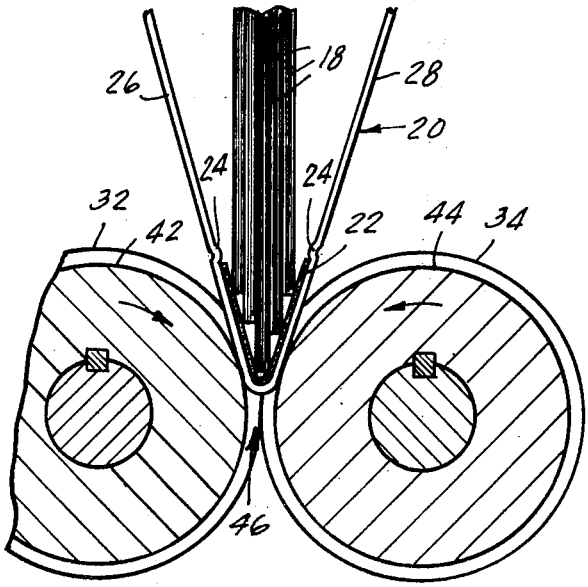
FIG. 4 is an enlarged end view of the roll pinching station of the machine of FIG. 1 and a fold-binder cover with sheets therein to be bound entering the roll pinching station.
Figure 5:
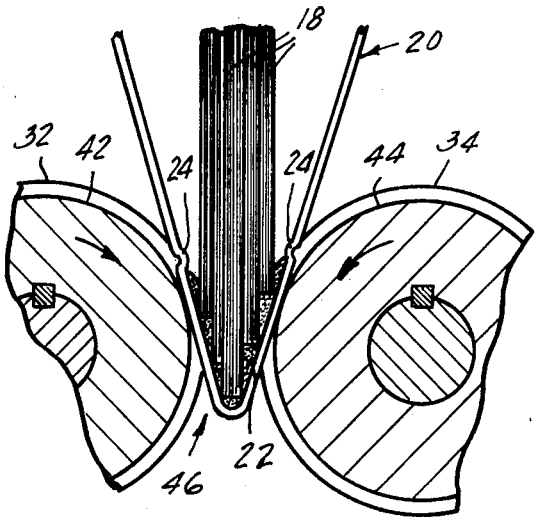
FIG. 5 is an enlarged end view of a fold-binder cover between the rolls of the roll pinching station.

The roll pinching station 16 comprises a pair of elongated rolls 32 and 34. These rolls are mounted with their axes disposed parallel to each other with both axes of the rolls preferably being disposed parallel to the heater unit 14. The rolls 32 and 34 may be made of all metal or may be made with a resilient surface. All metal rolls such as aluminum, for example, with good heat transfer properties, are more efficient in removing heat. Resilient surfaced rolls, however, apply pressure more uniformly and tend to guarantee nipping of covers without slipping. Suitable bearing journal means are provided within the housing to support the ends of the rolls therein. A slot 36 is formed in the upper part of the housing parallel to the rolls 32 and 34 and is adapted to receive a folded cover member therethrough which then is brought into contact with the adjacently disposed rollers 32 and 34. The ends of the shaft of one roll (here shown on roll 34) are disposed in a transverse slot 38 so that the roll 34 may be moved laterally back and forth to some degree. Tension springs 40 are connected at each end of the rolls to bias the rolls toward each other and to provide restoration of handle to the unoperated position. The springs also provide restoration energy so that handle will return to it's unoperated position. This could be shown in FIG. 2. It will be apparent from FIGS. 4 and 5, for example, that when a cover member 20 having sheets therein is inserted between the rolls they will be spread apart slightly against the tension of the springs 40. Each of the rolls 32 and 34 are formed with undercut portions 42 and 44 respectively, so that when the enlarged ends 32A, 34A and 32B, 34B are in contact with each other there is a gap 46 formed between the pair of rolls. A lever 48 is attached to one end of one of the rollers, here shown as being attached to the roll 32, and is rotatable between stops 50 and 52 to allow a limited rotation of the roll 32 by manipulation of the handle 48 between the stops.

Figure 2:
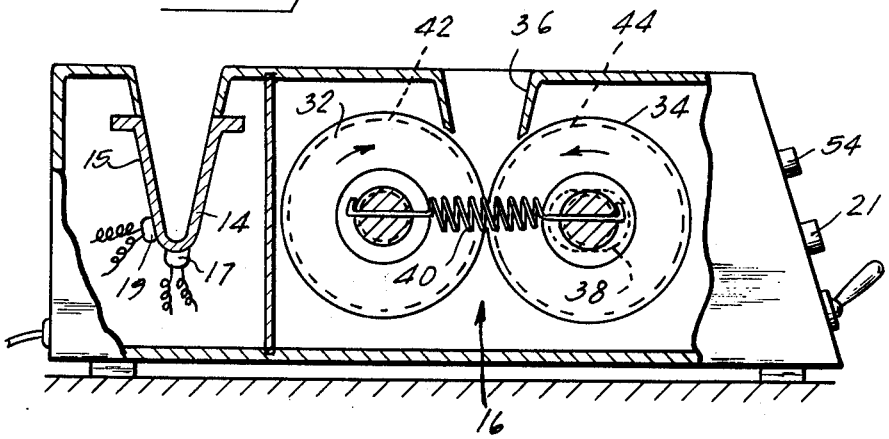
FIG. 2 is an enlarged end view in elevation of the machine of FIG. 1.

From FIGS. 1 and 2 it will be noted that the roll pinching station 16 is located very close to the heating station and is oriented vertically. The closeness is to minimize the heat loss of the cover and premature hardening of the adhesive while transferring hot assembled covers to the roll pinching station. Vertical orientation minimizes disruption of the assembled sheets and molten adhesive while moving heated covers to the roll pinching station. While other orientations will work and with almost any combination of oriented heaters, the fact remains that vertical rap, vertical transfer to a vertical heater, followed by vertical insertion into vertically oriented pinch rolls, is the most effective and preferred configuration.

Quite aside from the orientation of the roll pinching station, there are a number of reasons why this mode of finishing a heated cover is important. The roll pinching arrangement comprising the spring biased rolls 32 and 34 is the preferred method of squeezing an assembled fold-binder cover. The general object is to squeeze together the outer surfaces of the folded cover edge so that molten adhesive within the cover is squirted or redistributed away from the direction of the squeeze and into edges of the sheets within the cover. In theory, a properly rapped book distributes sheets in a staggered arrangement so that every sheet has an edge intimately in contact with adhesive. However, a sheet occasionally adheres to another sheet or an edge of one sheet masks another so that not all sheet edges will contact adhesive. If the latter is the case, excessive adhesive within the crotch of the binder will extrude or be squeezed into the collected edges of the sheets. This guarantees that all edges of all sheets will be contacted by molten adhesive and thus bound.

The gapping of the rolls by means of the gap 46 is an inexpensive way to aid in optimizing squeezing pressure for thin and thick books alike. In the described arrangement optimum squeeze takes place with a thick book. Gapped rolls are preferred because an inserted assembled cover tends to guarantee that the nipped edge will really be nipped into squeeze position without permitting the rolls to slip against the cover and fail to draw the assembled cover between the rolls. The machine has been designed to permit a limited rotation of the rolls, that is by means of the limited rotation which is provided by the lever 48. This permits just enough rotation to engage and squeeze the area containing the adhesive within the cover. Excessive rotation of the rolls would tend to cause the cover edge to pass through the rolls, that is, too far, and if it does not do so evenly, cause the folded edge to distort or flip one way or the other. This produces a bound book with unaesthetic appearance and possible disruption of the not yet completely cooled adhesive.

Roll pinching also is effective to remove heat from the hot folded edge of the assembled cover and, in so doing, molten adhesive within the cover congeals more quickly, this stabilizing the book in the desired configuration. A book bound in this manner tends to stabilize or become ready for handling in approximately one minute and reaches its ultimate integrity in four to five minutes. An unsqueezed book, on the other hand, tends to stabilize in two or more minutes and may not reach ultimate integrity until six or seven minutes have elapsed.

Roll pinching is also employed to squeeze together the hot folded edge of the fold-binder cover 20 to flatten the edge and to make sure that books bound successively have the same flattened appearance. If the edge is not squeezed together and cooled simultaneously, trapped air within the molten adhesive and between the pages to be bound tends to expand and puff up the area which has been heated so that the appearance from one cover to the next varies and is indeterminate.

Roll pinching limits the squeeze forces to the energy stored in the spring biasing means and the slight variation encountered because of varying thickness books. While other means of squeezing work, such as insertion of a book into a hinged member, an operator performing that function has no way to guarantee that he squeezed a book of a given thickness the same as any other book of the same thickness. It is important to limit the squeeze so that the adhesive will not extrude much beyond the intended binding area and certainly not out the ends of the book. Uncontrolled squeeze effort can produce this result. Inadequate squeeze effort, of course, may not distribute the adhesive, remove the heat efficiently, and/or provide good aesthetics. Thus the spring biased rolls give an even controlled squeeze completely independent of the operator.

Squeezing involving "stripping" the folded edge with thumb or a rounded pencil-like object works but it does not work as efficiently or simply as the roll pinching concept described herein. Stripping has the disadvantages of extruding adhesive out the end of the book in the event that improper pressures are applied. Furthermore, this technique, when delayed, may fail to remove heat uniformly, resulting in an unaesthetic appearance. Roll pinching, on the other hand, guarantees simultaneous squeezing of all parts of the folded edge of the book to achieve the desirable objectives noted above.

The machine 10 is also provided with a means to measure the dwell time of the cover paper assembly within the heater. This means includes a signal lamp 54 connected by appropriate electrical circuitry to flash at regular discreet intervals. The purpose of the flashing signal lamp is to provide the operator with an easy means of observing when the appropriate dwell time has elapsed. Preferably, in binding a book cover of the type contemplated by the mechanism herein and binding up to thirty sheets of paper therein, a dwell time of twelve seconds or slightly more is appropriate. Obviously, the flashing could be arranged for one second or any other number of seconds as desired. It has been found convenient to use a flash interval of three seconds so that an operator can conveniently count three, four or five flashes as may be necessary for the particular type of book being bound. This type of arrangement is simple, convenient and inexpensive and eliminates the need for an expensive timing means.

While a preferred embodiment of the invention has been disclosed, it will be appreciated that this has been shown by way of example only, and the invention is not to be limited thereto as other variations will be apparent to those skilled in the art and the invention is to be given its fullest possible interpretation within the terms of the following claims.

What is claimed is:

1. Apparatus for making a thin booklet by binding loose sheets into an adhesive folded cover comprising:

a housing, a longitudinally extending opening in the top of said housing;

a heater unit of generally deeply grooved cross-section open at the top and disposed in said housing facing said opening to receive therein from above, the folded edge of the adhesive cover;

heating element means operatively associated with said heater unit;

a pair of adjacently disposed elongated pinching roll members with their axes in substantially parallel relationship mounted in said housing and providing a nip therebetween, said nip being open at the exterior of the housing and adapted to receive therein the folded edge of the adhesive cover containing sheets to be bound therein.

2. The apparatus of claim 1 wherein said grooved heater unit is contoured to the approximate shape of an adhesive cover containing loose sheets to be bound and comprises a generally V-shaped groove with a rounded bottom surface.

3. The apparatus of claim 1 wherein said heater unit comprises two separate adjacently disposed elongated parts and means biasing said parts against each other and said parts being separable by the thrust of an adhesive cover therebetween.

4. The apparatus of claim 1 wherein said pinching roll are closely disposed to and in substantially parallel relation with said heater unit.

5. The apparatus of claim 1 wherein said pinching roll are laterally spaced in a horizontal plane and provide an opening facing upwardly.

6. The apparatus of claim 1 wherein said pinching roll are made of metal having good heat transfer properties.

7. The apparatus of claim 1 including spring means biasing said roll against each other.

8. The apparatus of claim 1 wherein said pinching roll are made of metal having good heat transfer properties and include resilient surfacing on said rolls.

9. The apparatus of claim 1 including means on said pinching roll defining a gap therebetween when the end portions of said roll are in contact with each other.

10. The apparatus of claim 1 including means associated with said roll for limiting the squeeze of said roll on an adhesive cover inserted therebetween.

11. The apparatus of claim 1 including signal lamp means operatively associated with said machine, and means associated with said signal lamp to flash said signal lamp at periodic intervals of predetermined duration to provide simple assistance to the machine operator to measure dwell time.

12. The apparatus of claim 1 including lever means associated with one of said pinching roll for rotating same when an adhesive cover is inserted between said roll to move the adhesive cover a predetermined distance between said roll in a direction substantially perpendicular to the fold in the cover.

13. The apparatus of claim 1 wherein said heater unit comprises an elongated grooved unit, said pinching rolls are made of metal, and further includes spring means operatively associated with at least one of said rolls to bias said rolls against each other.

14. The apparatus of claim 1 wherein, said heater unit comprises an elongated grooved unit, said pinching rolls are made of metal and have a resilient surfacing formed thereon, and further includes spring means operatively associated with at least one of said rolls to bias said rolls against each other.

* * * * *